US012421681B2

(12) United States Patent
Huang

(10) Patent No.: US 12,421,681 B2
(45) Date of Patent: Sep. 23, 2025

(54) MOORING DEVICE AND OPERATING METHOD THEREOF

(71) Applicant: SHIP AND OCEAN INDUSTRIES R&D CENTER, New Taipei (TW)

(72) Inventor: Chun-Chia Huang, New Taipei (TW)

(73) Assignee: SHIP AND OCEAN INDUSTRIES R&DCENTER, New Taipei (TW)

( * ) Notice: Subject to any disclaimer, the term of this patent is extended or adjusted under 35 U.S.C. 154(b) by 470 days.

(21) Appl. No.: 18/086,609

(22) Filed: Dec. 21, 2022

(65) Prior Publication Data

US 2024/0200296 A1 Jun. 20, 2024

(30) Foreign Application Priority Data

Dec. 14, 2022 (TW) ..... 111147974

(51) Int. Cl.
*E02B 3/26* (2006.01)
*B63B 21/00* (2006.01)
*E02B 3/24* (2006.01)

(52) U.S. Cl.
CPC ..... *E02B 3/26* (2013.01); *B63B 21/00* (2013.01); *E02B 3/24* (2013.01); *B63B 2021/006* (2013.01)

(58) Field of Classification Search
CPC . B63B 21/00; B63B 21/06; E02B 3/26; E02B 3/24
See application file for complete search history.

(56) References Cited

U.S. PATENT DOCUMENTS

2004/0182296 A1* 9/2004 Montgomery ..... E02B 3/24 114/230.1
2006/0081166 A1* 4/2006 Montgomery ..... B63B 21/00 114/230.1
2022/0411024 A1* 12/2022 Browne ..... E02B 3/26

* cited by examiner

*Primary Examiner* — Timothy D Collins
(74) *Attorney, Agent, or Firm* — Cheng-Ju Chiang

(57) ABSTRACT

The present invention discloses a mooring device and operating method thereof. Specifically, the mooring device mainly comprises engaging module and a pressure control module. The engaging module comprises at least one actuator, at least one piston unit and at least one vacuum cup. Moreover, when a mooring object contacts the at least one actuator and actuates the at least one piston unit, the pressure control module may control the vacuum level therebetween the at least one vacuum cup and the mooring object. Therefore, the mooring device and its operating method of the present invention use the force which is provided by the mooring object per se to determine whether to moor the mooring object or not.

10 Claims, 15 Drawing Sheets

MOORING DEVICE AND OPERATING METHOD THEREOF

TECHNICAL

The present invention discloses a mooring device and operating method thereof. Specifically, a mooring device and operating method which may transform the kinetic energy into the pneumatic/hydraulic pressure, actuating the at least one vacuum cup to create vacuum suction force for mooring the mooring object.

BACKGROUND OF THE RELATED ARTS

The commercial mooring device which has the vacuum cup basically has the mobile structure. Furthermore, the commercial mooring device are usually operated on the edge of the dock with numerous commercial mooring devices.

The abovementioned mooring device may use the vacuum cup which is configured in the end per se for engaging the mooring object. The mooring object comprises but not limits to ships, platforms or pontoon, etc. When mooring device contact the mooring object, a pump may ventilate the gas therein the vacuum cup, creating a vacuum suction force for mooring the mooring object.

At the same time, the abovementioned mooring device detects and monitors the vacuum suction force in real time, therefore to make sure the mooring force is enough between the mooring object. However, the vacuum suction force created by pumps which is used in such commercial technology usually requires the external energy supply for operating. In this case, the long-term maintenance may cause the significant waste problem in order to the external energy supply for creating the vacuum suction force in such way.

SUMMARY

To solve the problem mentioned in the prior art, the present invention provides a mooring device and operating method thereof. Specifically, the aforementioned mooring device comprises an engaging module and a pressure control module.

The engaging module comprises at least one actuator, at least one piston unit and at least one vacuum cup. The at least one piston unit is connected with the at least one actuator, and the at least one vacuum cup is configured on the anterior portion of the engaging module. Moreover, the pressure control module is connected with the engaging module, and the pressure control module comprises a first valve, at least one first pressure tank, a second valve, an energy transformation module, a vacuum module, a third valve and a fourth valve.

The first valve is connected with the at least one piston unit, and the at least one first pressure tank is connected with the first valve. Furthermore, the second valve is connected with the at least one first pressure tank, and the energy transformation module is connected with the second valve.

Thereinafter, the vacuum module is connected with the energy transformation module and the at least one vacuum cup, and the third valve is correspondingly connected with the energy transformation module and the at least one piston unit. At last, the fourth valve is connected with the at least one first pressure tank and the at least one piston unit.

On the other hand, the present invention further discloses an operating method of the mooring device. Specifically, the operating method of the mooring device firstly executes the step (A), therefore to provide the abovementioned mooring device. The step (B) is that the engaging module actively or relatively contacts a mooring object, and the mooring object engages with the at least one actuator.

Thereinafter, the step (C) is that the at least one actuator presses the at least one piston unit, and the first valve opens to make the at least one piston unit output a pneumatic/hydraulic pressure to the at least one first pressure tank. Moreover, the step (D) is that the first valve closes, and after the second valve opens, the at least one first pressure tank releases the pneumatic/hydraulic pressure and transmits the pneumatic/hydraulic pressure to the energy transformation module.

In step (E), this invention makes sure that the at least one vacuum cup is keeping directly contacting the mooring object. Therefore, the step (F) is that the energy transformation module uses the pneumatic/hydraulic pressure for actuating the vacuum module, making the vacuum module create vacuum suction force of the at least one vacuum cup and mooring the mooring object. The rest of the pneumatic/hydraulic pressure is stored in the energy transformation module.

Embodiments of the invention are illustrated by way of example, and not by way of limitation, in the figures of the accompanying drawings in which like reference numerals refer to similar elements.

DETAILED DESCRIPTION OF THE EMBODIMENT

In order to understand the technical features and practical efficacy of the present invention and to implement it in accordance with the contents of the specification, hereinafter, preferred embodiments of the present invention will be described in detail with reference to the accompanying drawings.

Figure 1:
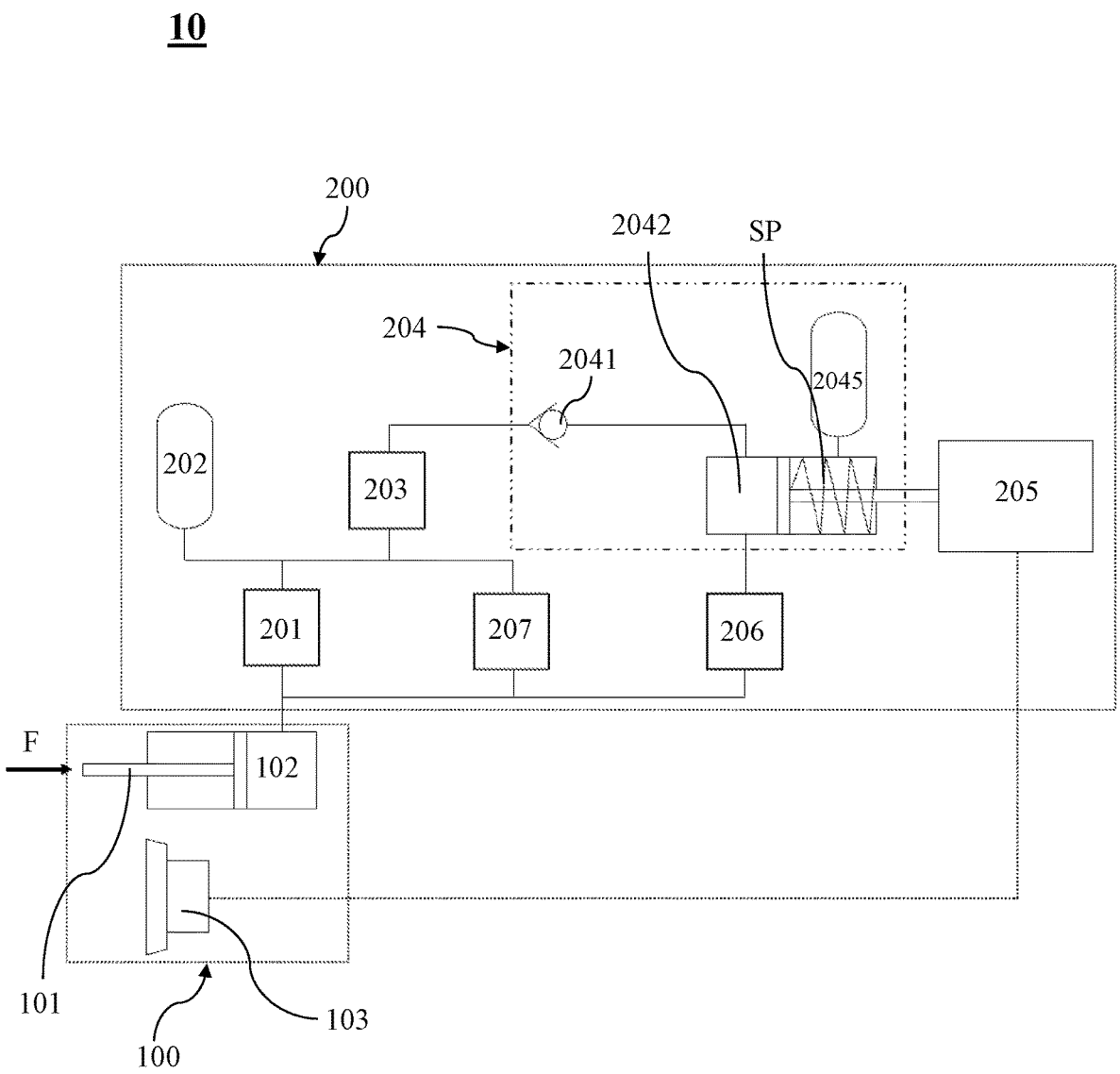
FIG. 1 is a schematic diagram of the system of one embodiment of the present invention.

Please refer to FIG. 1, FIG. 1 is a schematic diagram of the system of one embodiment of the present invention. As illustrated in FIG. 1, the mooring device 10 of the present embodiment comprises an engaging module 100 and a pressure control module 200.

The engaging module 100 comprises at least one actuator 101, at least one piston unit 102 and at least one vacuum cup 103. The at least one piston unit 102 is connected with the at least one actuator 101, and the at least one vacuum cup 103 is configured on the anterior portion of the engaging module 100. Please refer to FIG. 13, FIG. 13 is a schematic diagram of the configurations between the actuator and the vacuum cup of one embodiment of the present invention.

Figure 13:
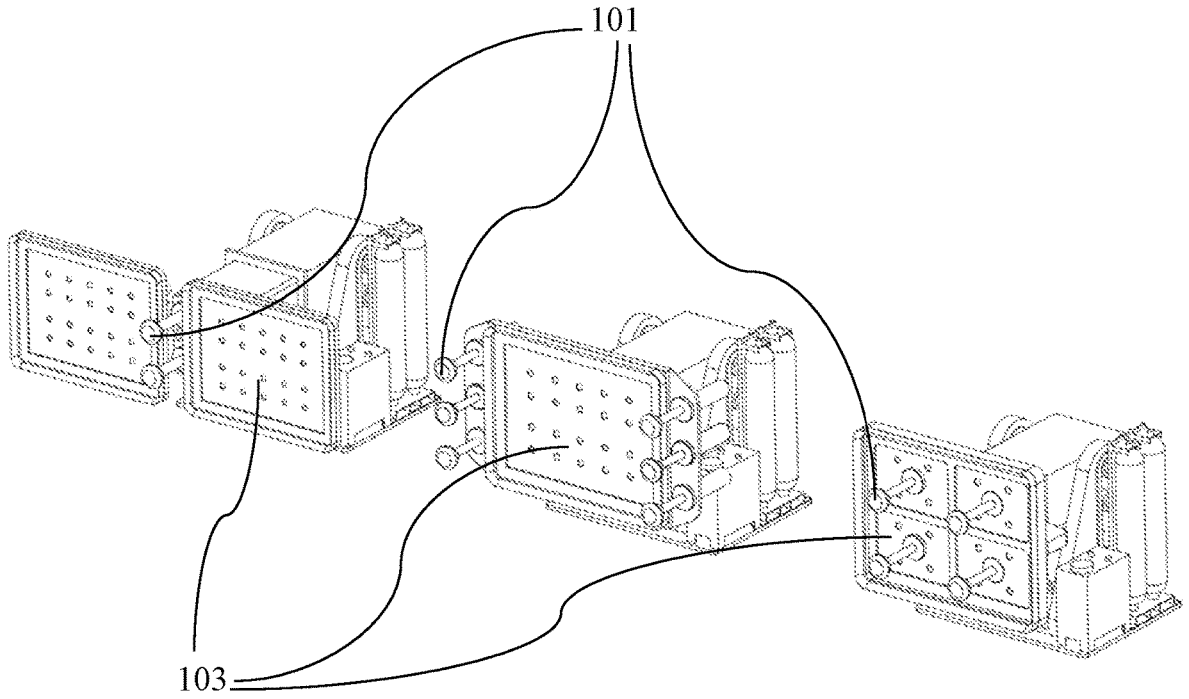
FIG. 13 is a schematic diagram of the configurations between the actuator and the vacuum cup of one embodiment of the present invention.

As shown in FIG. 13, in the embodiment created under the concept of this invention, the configuration of actuator 101 may comprise but not be limited to be configured on/in two sides/middle of vacuum cup 103 or directed configured on the contacting area of the vacuum cup 103, the present invention is not limited thereto.

Thereon, the pressure control module 200 of the embodiment illustrated in FIG. 1 is connected with the engaging module 100. The pressure control module 200 mentioned herein comprises a first valve 201, at least one first pressure tank 202, a second valve 203, an energy transformation module 204, a vacuum module 205, a third valve 206 and a fourth valve 207. In the present embodiment, the first valve 201, second valve 203, third valve 206 and the fourth valve 207 are electromagnetic valves.

Furthermore, the first valve 201, second valve 203, third valve 206 and fourth valve 207 may further connect to at least one controller which is not shown in the drawings. The at least one controller comprises Central Processing Unit (CPU), Micro-processor Unit (MPU), Single-chip microcomputer, Programmable logic controller (PLC) or combinations thereof.

Therefore, the present embodiment may be operated under the assistance of sensors. The sensors comprise but not be limited to pressure sensors thereof. The information acquired by the sensors may assist the whole mooring device 10 and for the at least one controller, thus to control the open/close of the first valve 201, second valve 203, third valve 206 and fourth valve 207. Hence, the pneumatic/hydraulic pressure will be managed well in the pressure control module 200.

On the other hand, the first valve 201 is connected with the at least one piston unit 102, and the at least one first pressure tank 202 is connected with the first valve 201. In fact, when the at least one piston unit 102 of the present embodiment is pressed by the actuator 101 due to the external force F (e.g., the external force created by mooring object M), the pneumatic/hydraulic pressure of the piston unit 102 raises therein. Simultaneously, the first valve 201 will open and the second valve 203 and the fourth valve 207 will be relatively closed. Hence, the pneumatic/hydraulic pressure in the piston unit 102 will be transmitted to and accumulated in the at least one first pressure tank 202.

Furthermore, due to the connection between the second valve 203 and at least one first pressure tank 202 and the connection between the energy transformation module 204 and second valve 203, when the actuator 101 of the present embodiment is pressed by such as the external force F, thus to retract to the position/status preset by the system or detected by sensors in the mooring device 10, making sure that the mooring object M has been contacted with the vacuum cup 103. The first valve 201 will be closed, and the second valve 203 will open and make the pneumatic/hydraulic pressure therein the at least one first pressure tank 202 be transmitted into the energy transformation module 204.

Figure 2:
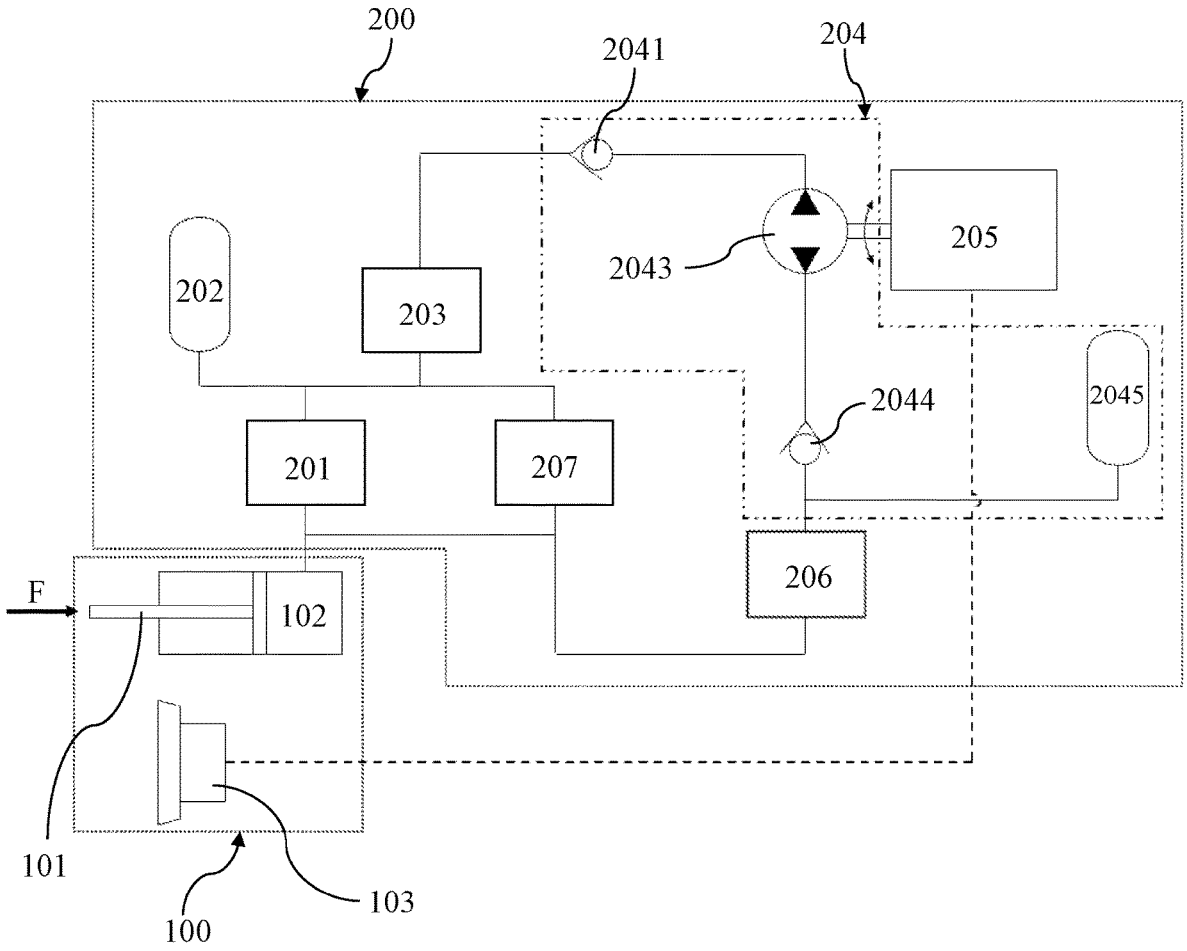
FIG. 2 is a schematic diagram of the system of another embodiment of the present invention.

Thereinafter, please refer to FIG. 1 and FIG. 2 simultaneously, FIG. 2 is a schematic diagram of the system of another embodiment of the present invention. The difference between the FIG. 1 and the FIG. 2 is the design of the energy transformation modules 204. Specifically, the embodiment illustrated in FIG. 1, the energy transformation module 204 selects the linear piston 2042 as the energy transformation method per se. However, in embodiment illustrated in FIG. 2, a rotational unit 2043 is selected therein. No matter the linear piston 2042 illustrated in FIG. 1 or the rotational unit 2043 illustrated in FIG. 2, the designs therebetween these two embodiments are used for transforming the pneumatic/hydraulic pressure sent from the second valve 203 to kinetic energy, therefore to create the vacuum suction force. The present invention is not limited thereto.

According the embodiment illustrated in FIG. 1, the energy transformation module 204 comprises first check valve 2041, linear piston 2042 and at least one second pressure tank 2045. The first check valve 2041 is connected with the second valve 203, and the linear piston 2042 comprises elastic resetting unit SP, at least one second pressure tank 2045 or the combinations thereof. The linear piston 2042 is connected with the first check valve 2041 and the vacuum module 205. The linear piston 2042 of this embodiment comprises the elastic resetting unit SP, and further comprises the at least one second pressure tank 2045. The aforementioned elastic resetting unit SP may help the linear piston 2042 automatically reset, and the at least one second pressure tank 2045 may receive the excessive pneumatic/hydraulic pressure when the linear piston 2042 comprises gas or liquid therein. Therefore, the elastic resetting unit SP and the second pressure tank 2045 may be solely used or be simultaneously used due to the needs of linear piston 2042, the present invention is not limited thereto.

The energy transformation module 204 illustrated in the embodiment of FIG. 2 comprises a first check valve 2041, a rotational unit 2043, a second check valve 2044 and at least one second pressure tank 2045. The first check valve 2041 is connected with the second valve 203, and the rotational unit 2043 is connected to the first check valve 2041 and vacuum module 205. On the other hand, the second check valve 2044 is connected to the rotational unit 2043. The at least one second pressure tank 2045 is connected to the second check valve 2044. In current embodiment, the at least one second pressure tank 2045 further connects to third valve 206. That is, the at least one second pressure tank 2045 is configured between the second check valve 2044 and third valve 206.

Therefore, in the embodiment illustrated in FIG. 2, when the pneumatic/hydraulic pressure passes the second valve 203 to the rotational unit 2043, the pneumatic/hydraulic pressure may provide the energy for the rotation of rotational unit 2043. Thereafter, the rotational unit 2043 may make the vacuum module 205 create the vacuum suction force. However, considering that the rotational unit 2043 does not have a closed chamber, the pneumatic/hydraulic pressure which passes though the rotational unit 2043 may further be stored in the at least one second pressure tank 2045 after the pneumatic/hydraulic pressure passes through the second check valve 2044 due to the close of the third valve 206.

No matter the embodiments illustrated in FIG. 1 or FIG. 2, the vacuum modules 205 are connected with the energy transformation module 204 and at least one vacuum cup 103. Hence, the vacuum module 205 may create vacuum of the at least one vacuum cup 103 via the energy transformation module 204, and the second valve 203 may be used for controlling the level of vacuum to moor or release the mooring object M.

On the other hand, no matter the embodiments illustrated in FIG. 1 or FIG. 2, the third valve 206 is connected with the energy transformation module 204 and the at least one piston unit 102. The fourth valve 207 is connected with the at least one first pressure tank 202 and the at least one piston unit 102. Specifically, the third valve 206 and fourth valve 207 are mainly used when the mooring object M is needed to be separated from the vacuum cup 103. When the mooring object M has not been moored, the third valve 206 and the fourth valve 207 will be opened and respectively release the pressure stored in the at least one first pressure tank 202, pressure stored in the at least one second pressure tank 2045 of the energy transformation module 204 and the energy accumulated in the suppressed elastic resetting unit SP due to the actuation of vacuum module 205.

Therefore, the abovementioned pressure or energy can be returned to at least one piston unit 102 in a form of pneumatic/hydraulic pressure in the gas-hydraulic circuit of the current system via the third valve 206 and fourth valve 207 after the vacuum module 205 removes the vacuum status of the vacuum cup 103. Thereinafter, the actuator 101 will be pressed by an opposite force against the external force F, resetting to the original status before mooring. Specifically, the vacuum status of the vacuum cup 103 is removed by a pressure relief valve (not shown in drawings) configured between the vacuum cup 103 and vacuum module 205.

Figure 14:
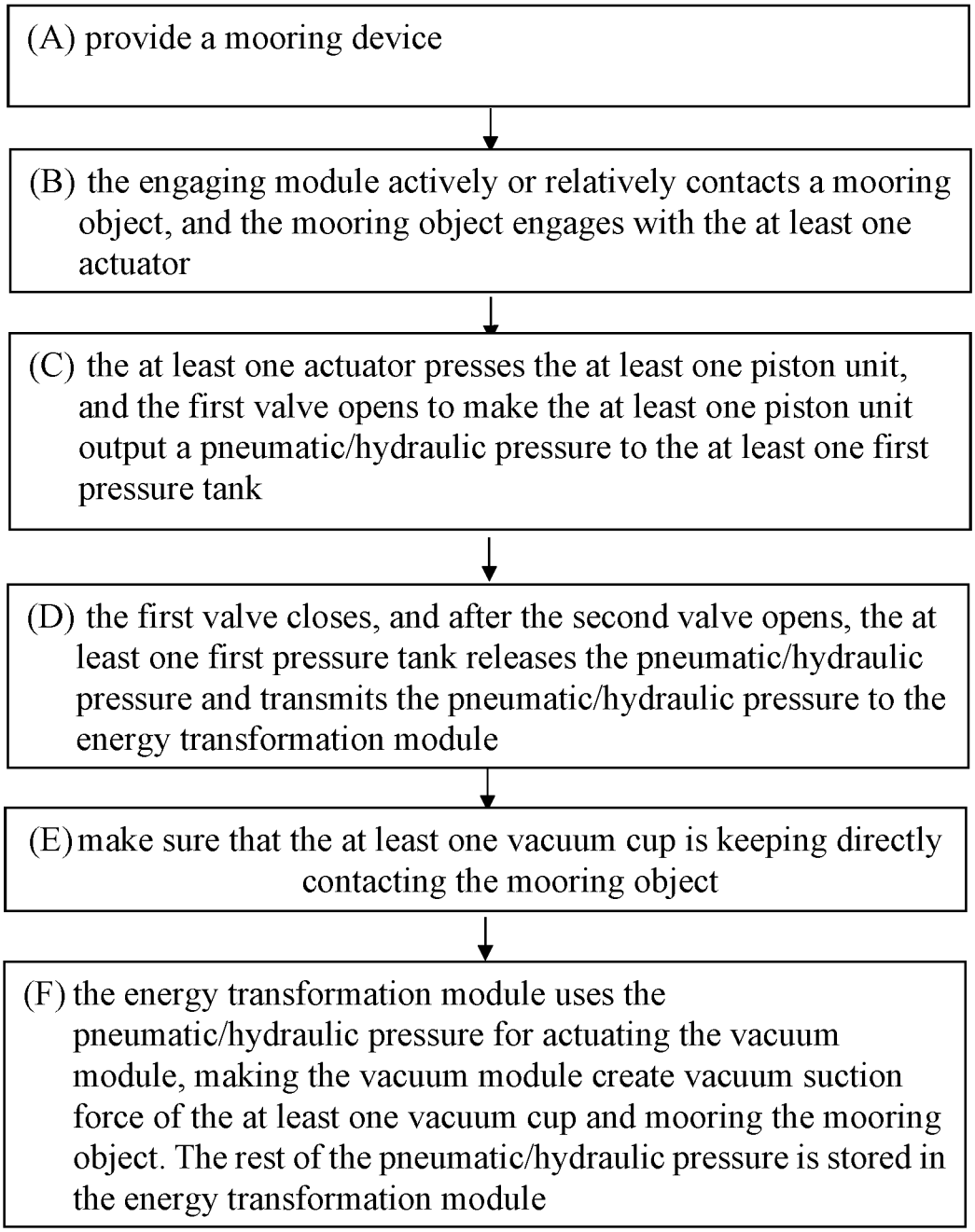
FIG. 14 is a flow chart of one embodiment of the present invention.

Please refer to FIG. 3 to FIG. 12 and FIG. 14. FIG. 3 to FIG. 7 are schematic diagrams for explaining mechanisms of another embodiment of the present invention. FIG. 8 to FIG. 12 are schematic diagrams for explaining mechanisms of the other embodiment of the present invention. FIG. 14 is a flow chart of one embodiment of the present invention.

First of all, the actual operation drawings of the embodiment illustrated in FIG. 3 to FIG. 7 is the "active type" embodiment of the present invention. On the other hand, the embodiment illustrated in FIG. 8 to FIG. 12 is the "passive type" embodiment of the present invention.

Figure 3:
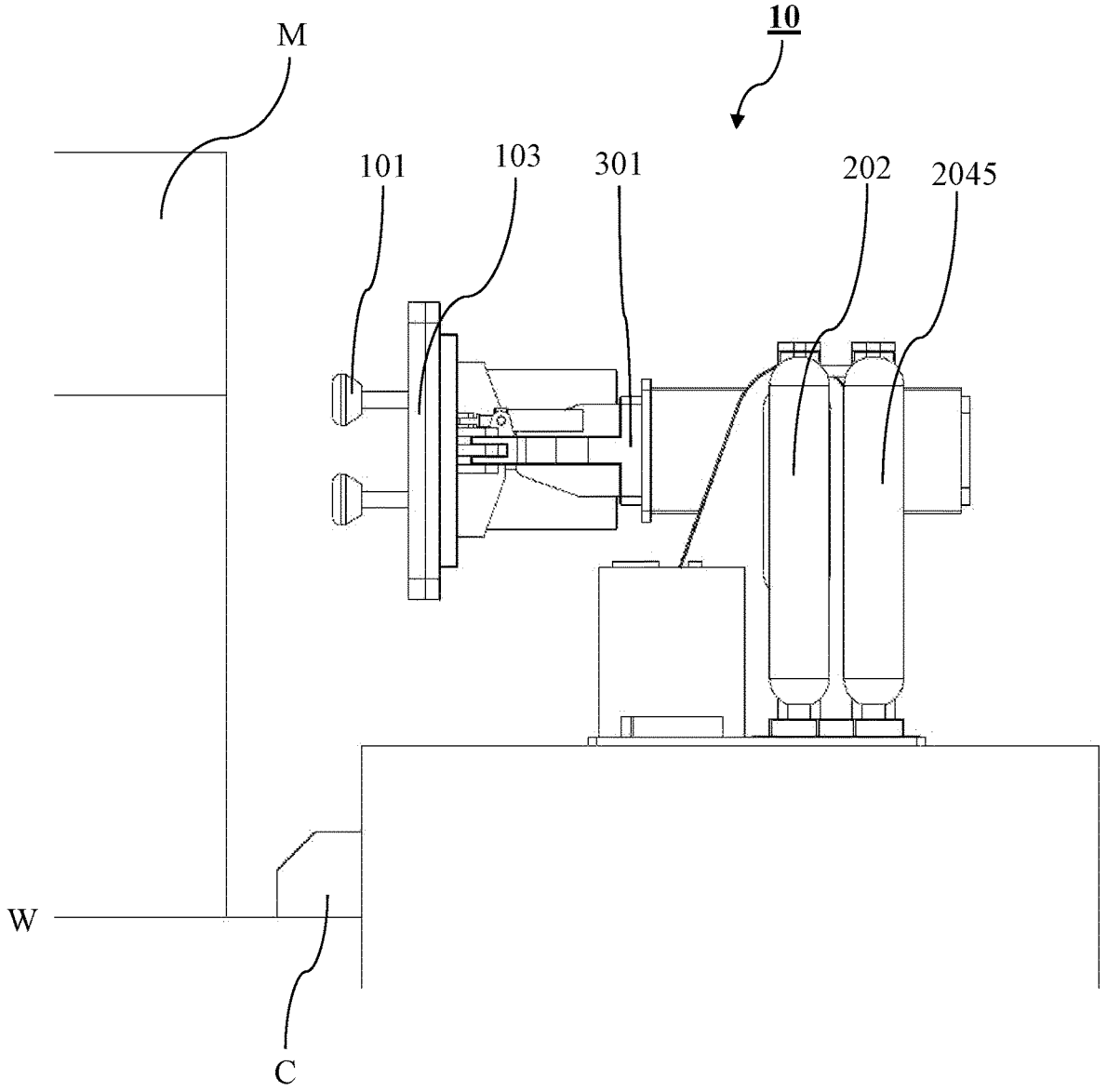
FIG. 3 to FIG. 7 are schematic diagrams for explaining mechanisms of another embodiment of the present invention.
Figure 4:
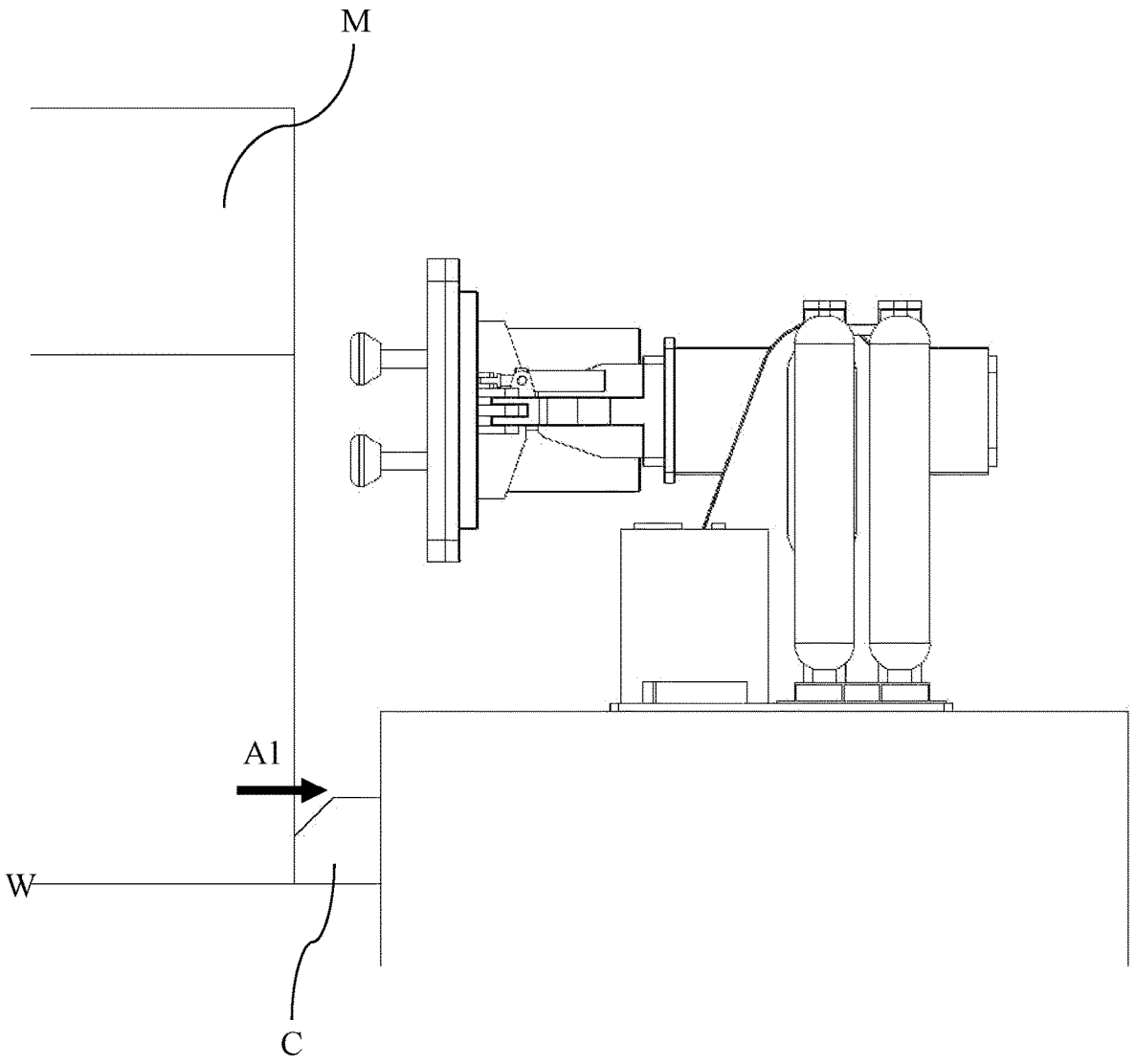
Figure 5:
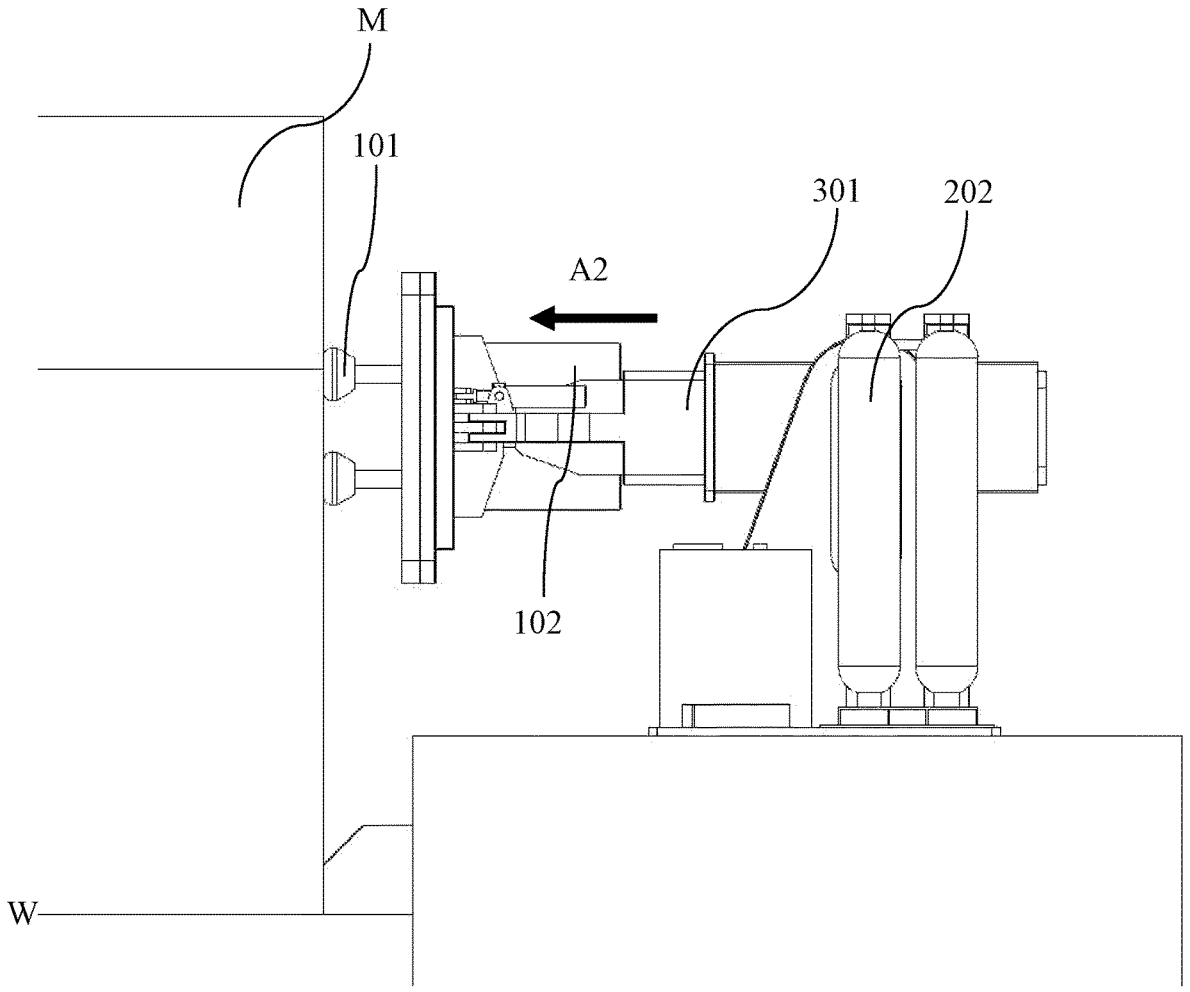

Specifically, as shown in FIG. 3, the "active type" in this embodiment means that the actuator 101 and the vacuum cup 103 is configured on the telescopic arm 301. Therefore, the actuator 101 will not exceeds the area of the bumper C of dock while the actuator 101 is not actuated. However, when the mooring object M float on the water line W approaches and contacts the bumper C along the direction of arrow A1, the telescopic arm 301 will extends to the direction along the arrow A2 of FIG. 5 to mooring object M. Therefore, the actuator 101 may contact the mooring object M. Finally, as the direction illustrated by the arrow A3 of FIG. 6, the actuator 101 will be pressed and the vacuum cup 103 will contacts mooring object M. The status shown in FIG. 7 has therefore been formed.

The abovementioned description of the FIG. 3 to FIG. 7 is how to make telescopic arm 301 actively extend outward the dock and make the actuator 101 be pressed, thus to let the piston unit 102 create the pneumatic/hydraulic pressure. Furthermore, the situation of the embodiment of FIG. 8 is that the actuator 101 and the vacuum cup 103 are originally extend outward the dock.

Figure 8:
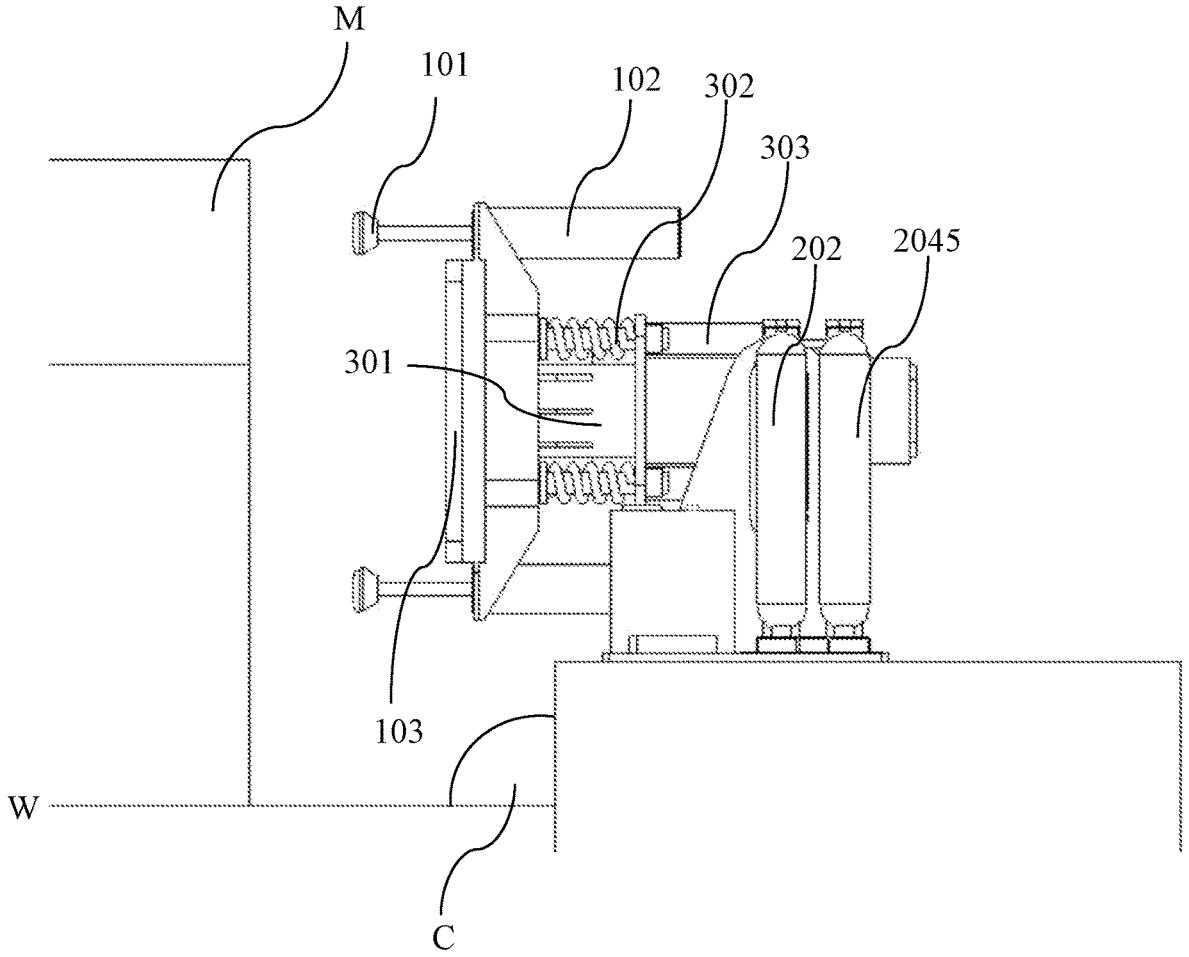
FIG. 8 to FIG. 12 are schematic diagrams for explaining mechanisms of the other embodiment of the present invention.
Figure 9:
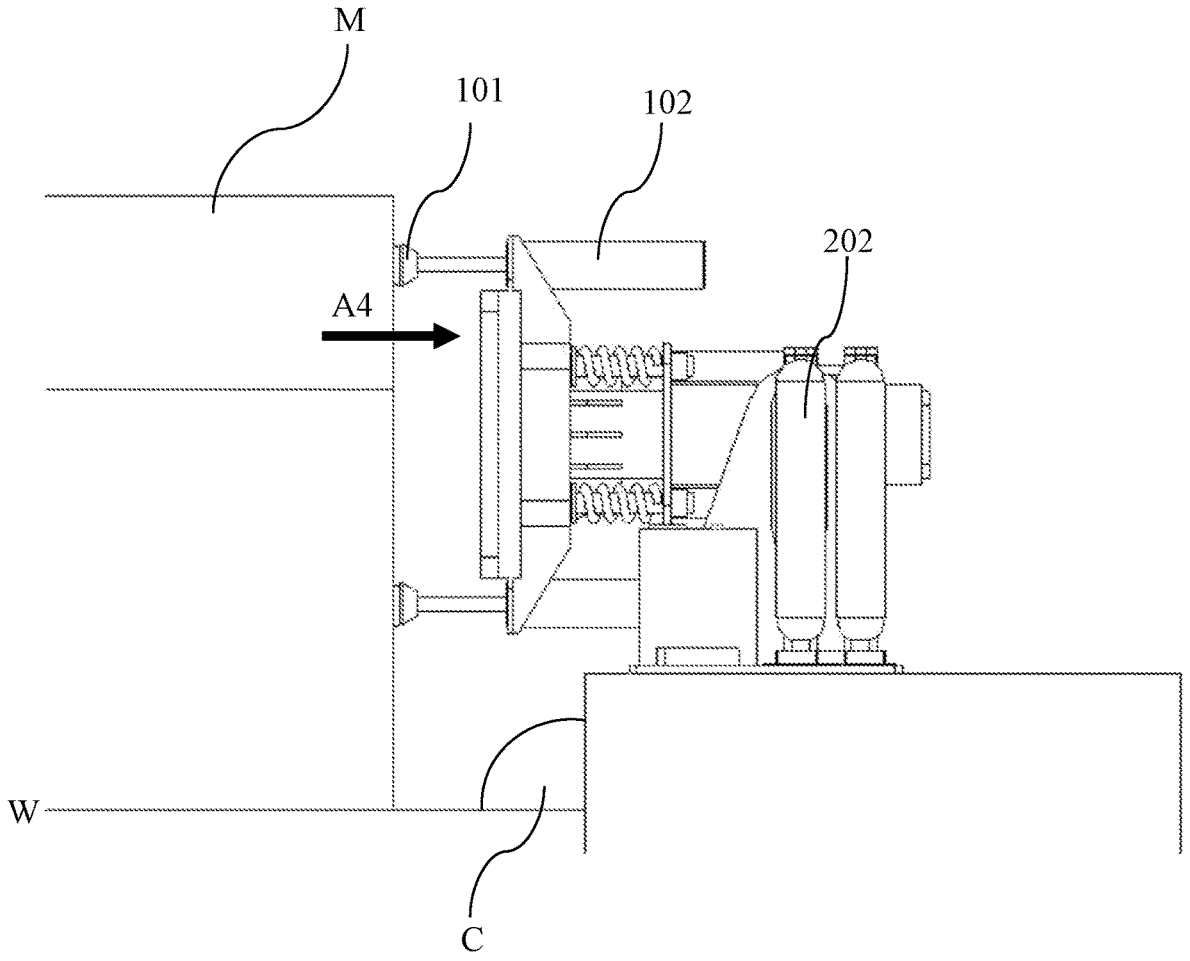

As shown in FIG. 8, when the mooring object M is needed to be moored, the mooring object M may close to and contact the actuator 101 in a direction of arrow A4 in FIG. 9. The actuator 101 herein is designed to be capable for the external force F, the force created by the mooring object M may be absorbed by the actuator 101 as shown in the direction of arrow A5 in FIG. 10, and the mooring object M directly contacts the vacuum cup 103. Thereinafter, when the vacuum cup 103 moors the mooring object M via the vacuum suction force, the further force created by the mooring object M is illustrated as the arrow A6 of FIG. 11. When the mooring object M contacts the bumper C and the vacuum cup 103, the vacuum cup 103 will started to create the vacuum status. At the same time, the external force created by the mooring object M will be buffered by the elastic unit 302 which is configured behind the vacuum cup 103. Furthermore, in order to the reset force created by the elastic unit 302, the vacuum cup 103 may have a force for keeping contacting the mooring object M.

Figure 12:
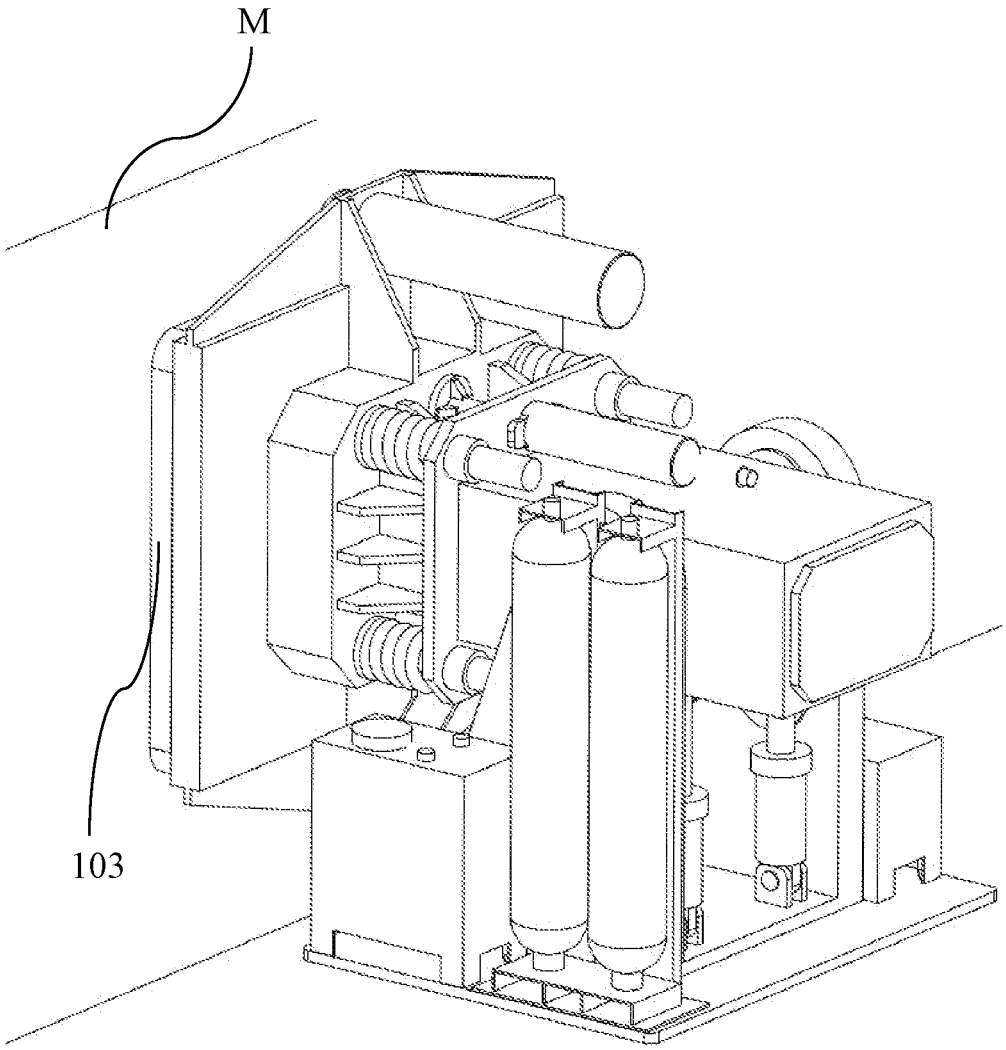

In the present embodiment, the elastic unit 302 may be any unit which has buffering or resetting abilities such as a spring, the present invention is not limited thereto. When the elastic unit 302 is suppressed and provides the force for vacuum cup 103 contacting mooring object M due to the resetting force per er, after the vacuum cup 103 has accomplished the vacuum status, the double rod cylinder 303 which is connected with the vacuum cup 103 will control its own valve for limiting and locking the linear motion and position of telescopic arm 301. Finally, the mooring status as shown in FIG. 12 has been formed. Therefore, the embodiment illustrated in FIG. 8 to FIG. 12 passively deals with the external force F created by mooring object M because this embodiment comprises elastic unit 302 and double rod cylinder 303. On the other hand, the vacuum status of vacuum cup 103 created by the external force F also helps for accomplishing the mooring operation.

No matter the embodiment illustrated in FIG. 3 to FIG. 7 or the embodiment illustrated in FIG. 8 to FIG. 12, the mooring device 10 may comprise a support structure which comprises rotary shaft, hydraulic cylinder or various mechanical connection combinations for compensating motion of the mooring object M floated on the water line W, the present invention is not limited thereto. Therefore, no matter the actions produced by these external force F, or when the components such as pumps or blowers such as linear piston 2042 or rotary unit 2043 are actuated by pneumatic/hydraulic pressure, the mechanical energy of these actions can be transformed into electricity thereby generator or battery. The aforementioned electricity is used to supply power for telescopic arm 301 or the controller for controlling the open/close of each valve, the present invention is not limited, either.

Please refer to the FIG. 14. As shown in FIG. 14, the operating method of mooring device 10 in step (A) is to provide any of the mooring device 10 mentioned above. The mooring device 10 may be the "active type" or "passive type" mooring device 10 illustrated in FIG. 3 or FIG. 8 respectively, or further be the mooring device which has different vacuum suction force creating method illustrated in FIG. 1 or FIG. 2, the present invention is not limited thereto.

Figure 6:
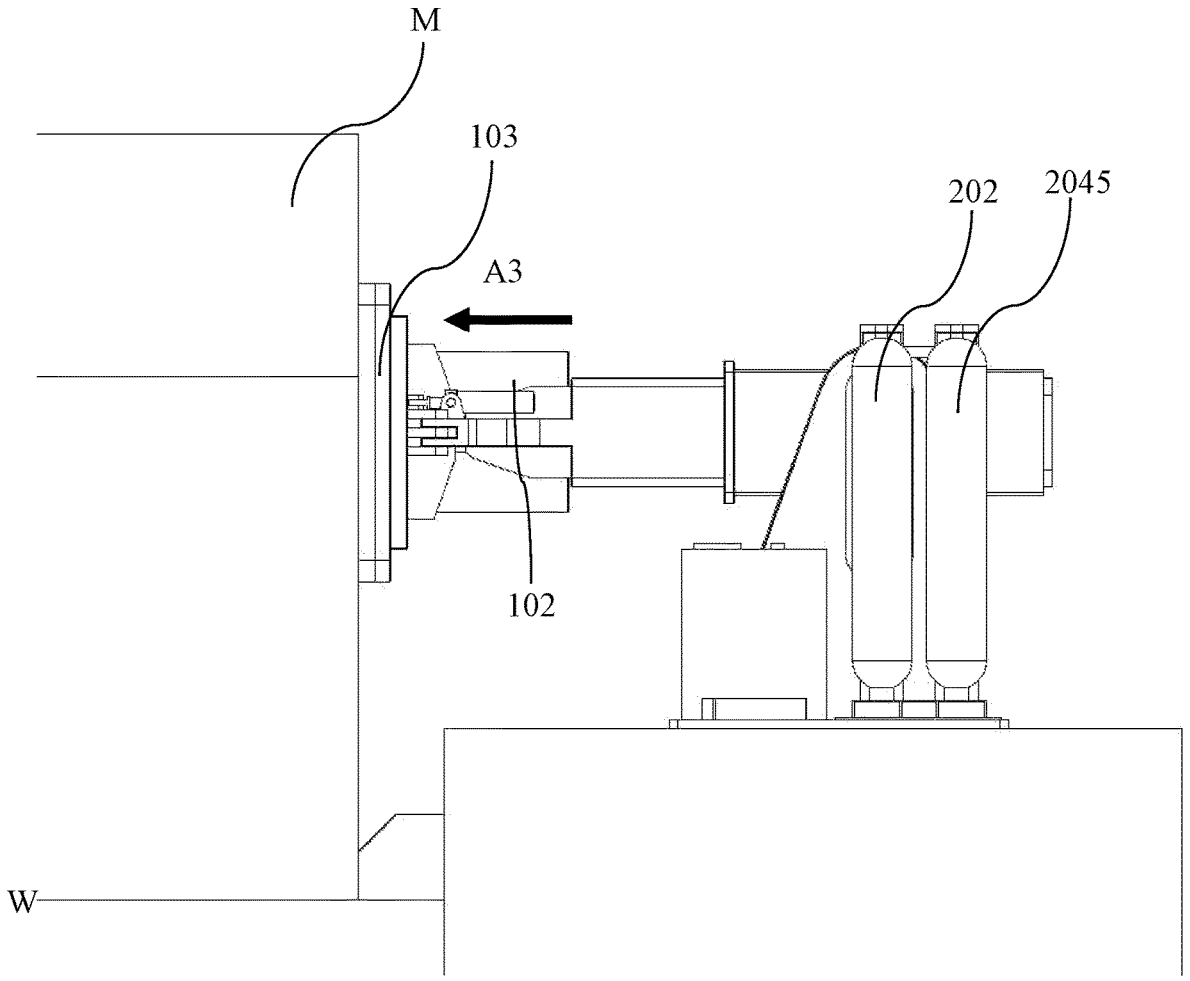
Figure 10:
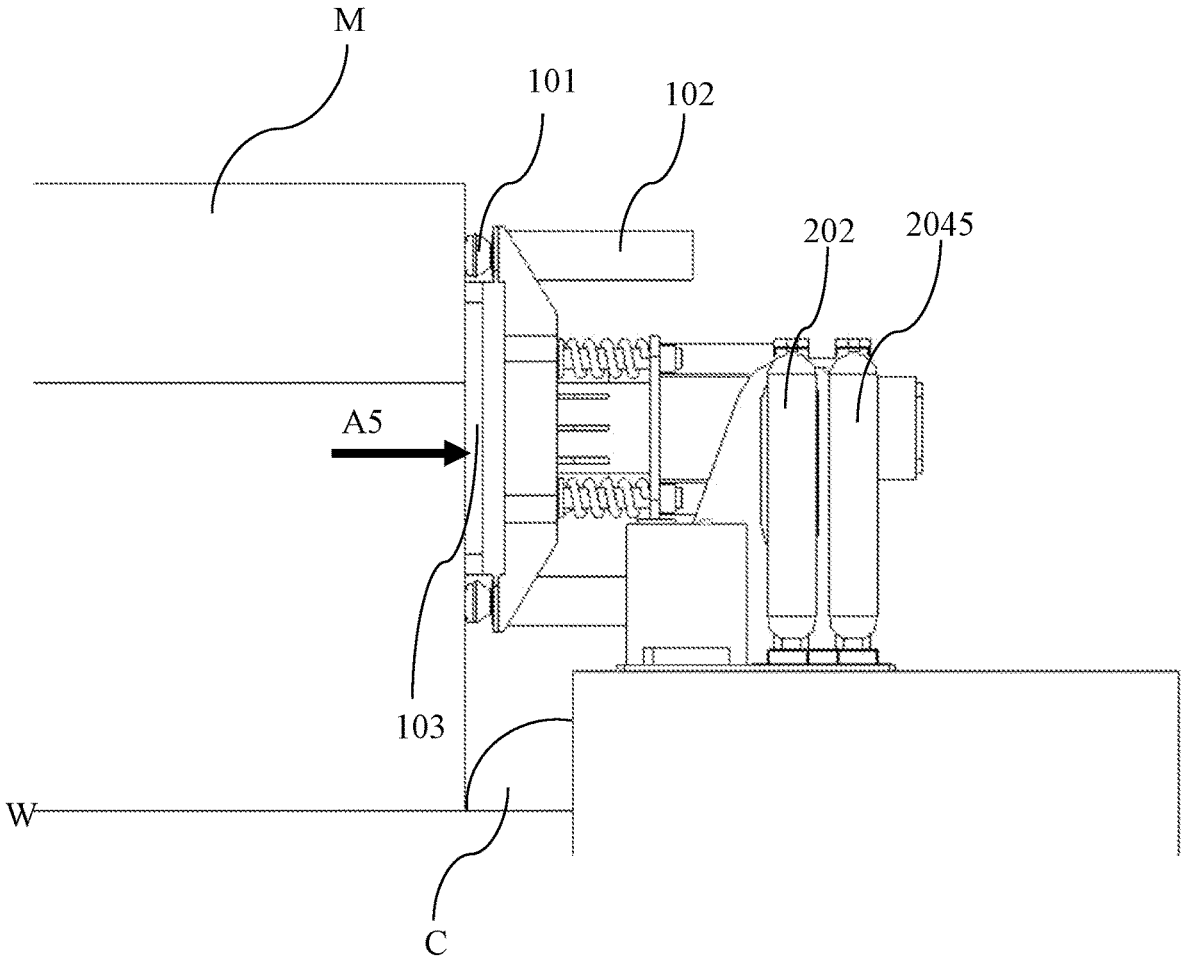
Figure 11:
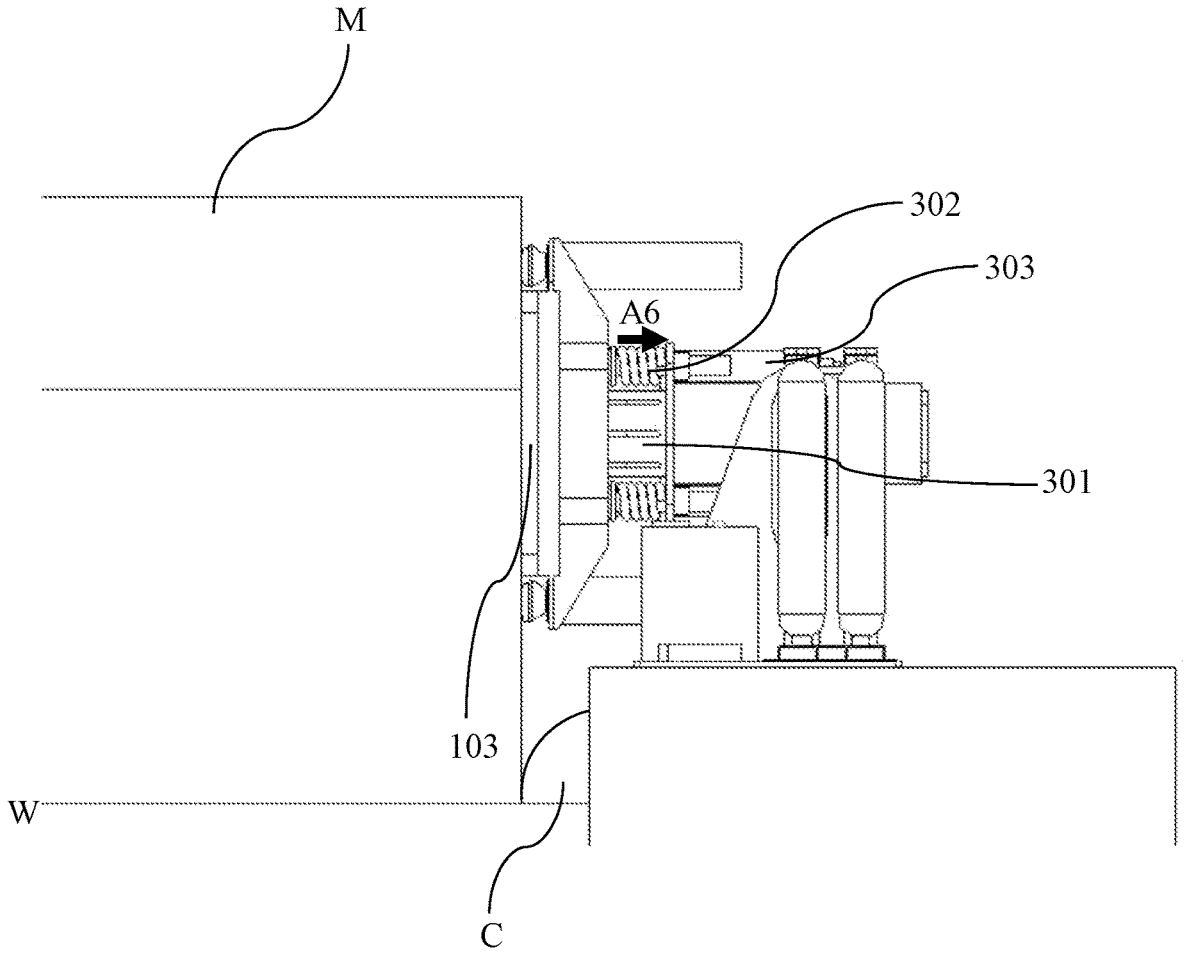

The step (B) is that the engaging module 100 actively (e.g., the embodiment of FIG. 3 to FIG. 7) or relatively (e.g., the embodiment of FIG. 8 to FIG. 12) contacts the mooring object M. Thus the mooring object M presses the at least one actuator 101, presenting the status as illustrated in FIG. 6 or FIG. 10.

Thereinafter, the step (C) is that the at least one actuator 101 presses the at least one piston unit 102 as illustrated in FIG. 1 or FIG. 2, and the first valve 203 opens and the pneumatic/hydraulic pressure output by the at least one piston unit 102 will be transmitted to the at least one first pressure tank 202. Moreover, the step (D) is that the first valve 203 is closed. After the second valve 203 has been opened, the pneumatic/hydraulic pressure released by the at least one first pressure tank 202 will be transmitted to the energy transformation module 204.

Figure 7:
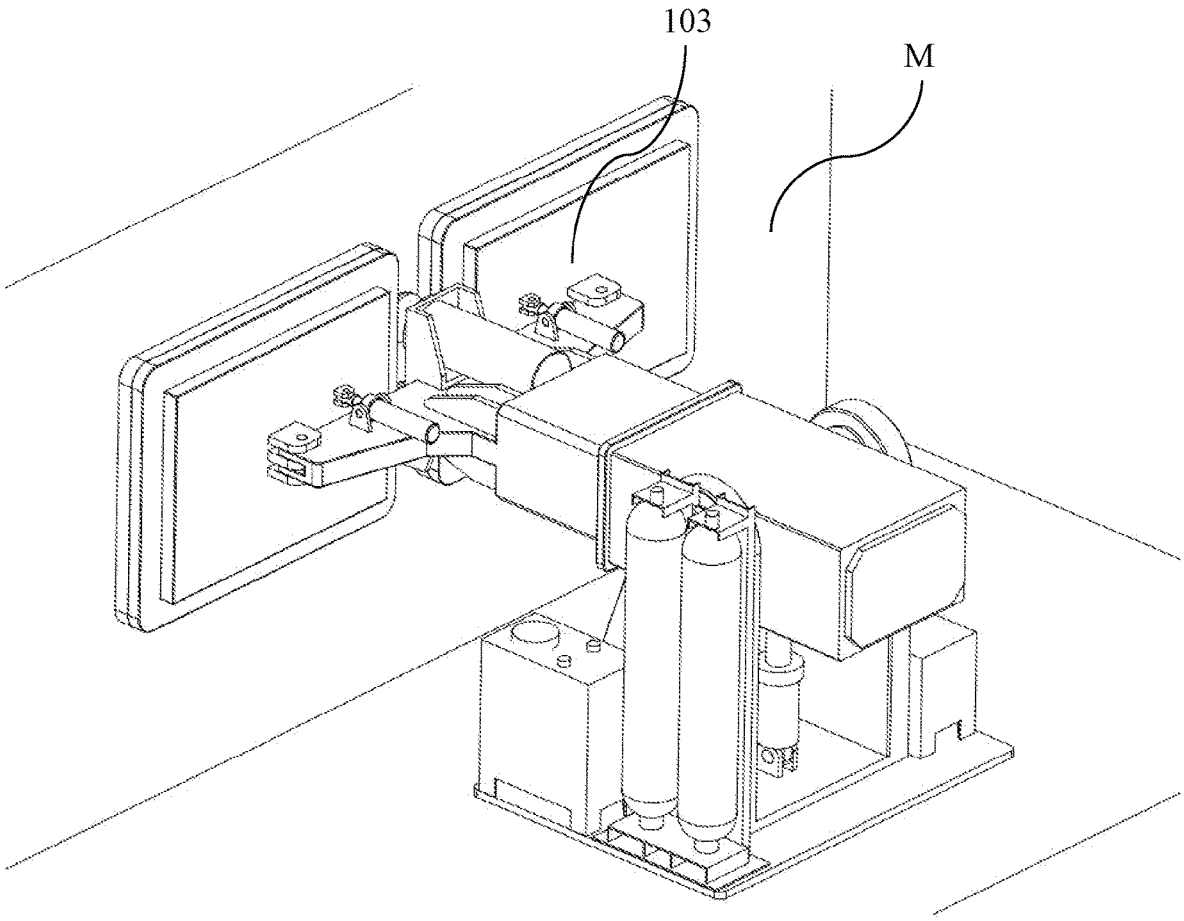

In step (E), after checking that the at least one vacuum cup 103 tightly contacts the mooring object M as illustrated in FIG. 7 or FIG. 12, the step (F) will be executed. Step (F) is that the energy transformation module 204 actuates the vacuum module 205 via the pneumatic/hydraulic pressure, and the vacuum module 205 creates the vacuum status (vacuum suction force) for the at least one vacuum cup 103, therefore to moor the mooring object M. On the other hand, the excessive pneumatic/hydraulic pressure is stored in the energy transformation module 204 and first pressure tank 202, and the mooring has been accomplished.

Figure 15:
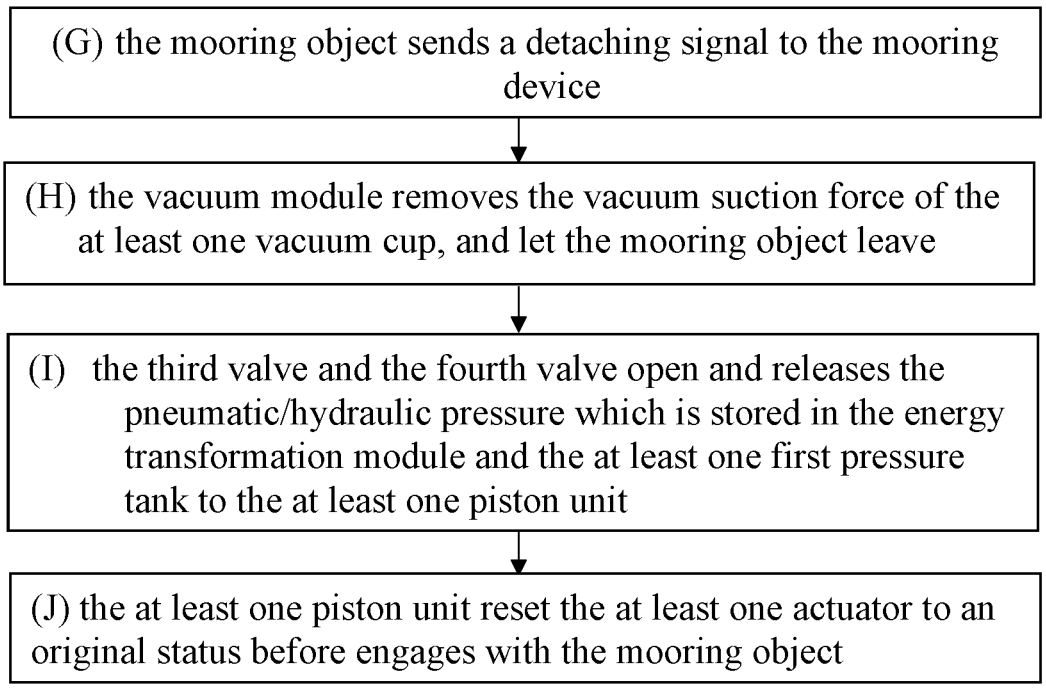
FIG. 15 is a flow chart of the other embodiment of the present invention.

Please refer FIG. 15, FIG. 15 is a flow chart of the other embodiment of the present invention. As shown in FIG. 15, when the mooring object M has to leave and unmoor, Step (G) may be executed. The step (G) is that the mooring object M may wired or wirelessly send the detaching signal to the at least one controller of mooring device 10.

The step (H) is that the vacuum module 205 removes the vacuum status of the at least one vacuum cup 103, and the mooring object M may leave. At the same time, step (I) is that the at least one controller controls the opening of third valve 206 and the fourth valve 207, and releases the pneumatic/hydraulic pressure stored in the at least one second pressure tank 2045 of energy transformation module 204 and the at least one first pressure tank 202 to the at least one piston unit 102. Finally, step (J) is that the at least one piston unit 102 will be reset, and the at least one actuator 101 is also reset to the status as shown in FIG. 3 or FIG. 8, which has not contacted the mooring object M, for waiting to moor the next mooring object M.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure. While the preferred embodiment of the invention has been illustrated and described, it will be appreciated that various changes can be made therein without departing from the spirit and scope of the invention.

What is claimed is:

1. A mooring device, comprising:

an engaging module, comprising:

at least one actuator;

at least one piston unit, connected with the at least one actuator;

at least one vacuum cup, configured in anterior portion of the engaging module;

a pressure control module, connected with the engaging module; wherein the pressure control module comprises:

a first valve, connected with the at least one piston unit;

at least one first pressure tank, connected with the first valve;

a second valve, connected with the at least one first pressure tank;

an energy transformation module, connected with the second valve;

a vacuum module, connected with the energy transformation module and the at least one vacuum cup;

a third valve, connected with the energy transformation module and the at least one piston unit; and a fourth valve, connected with the at least one first pressure tank and the at least one piston unit.

2. The mooring device as claimed in claim 1, wherein the at least one piston unit is piston rod.

3. The mooring device as claimed in claim 1, wherein the first valve, the second valve, the third valve and the fourth valve are electromagnetic valves.

4. The mooring device as claimed in claim 3, wherein the first valve, the second valve, the third valve and the fourth valve further connect to at least one controller.

5. The mooring device as claimed in claim 4, wherein the at least one controller comprises Central Processing Unit (CPU), Micro-processor Unit (MPU), Single-chip microcomputer, Programmable logic controller (PLC) or combinations thereof.

6. The mooring device as claimed in claim 1, wherein the energy transformation module comprises:

a first check valve, connected with the second valve; and a linear piston, connected with the vacuum module, and the linear piston comprises an elastic resetting unit, at least one second pressure tank or combinations thereof;

wherein the linear piston is connected with the third valve.

7. The mooring device as claimed in claim 1, wherein the energy transformation module comprises:

a first check valve, connected with the second valve;

a rotational unit, connected with the first check valve and the vacuum module;

a second check valve, connected with the rotational unit; and at least one second pressure tank, connected with the second check valve;

wherein the at least one second pressure tank is connected with the third valve.

8. The mooring device as claimed in claim 1, wherein the engaging module is connected with at least one telescopic arm and at least one elastic unit, at least one double rod cylinder or combinations thereof.

9. An operating method of a mooring device, comprising:

(A) providing the mooring device as claimed in claim 1;

(B) the engaging module actively or relatively contacting a mooring object, and the mooring object engaging with the at least one actuator;

(C) the at least one actuator pressing the at least one piston unit, and the first valve opening to make the at least one piston unit output a pneumatic/hydraulic pressure to the at least one first pressure tank;

(D) the first valve closing, and after the second valve opening, the at least one first pressure tank releasing the pneumatic/hydraulic pressure and transmitting the pneumatic/hydraulic pressure to the energy transformation module;

(E) making sure that the at least one vacuum cup is keeping directly contacting the mooring object; and (F) the energy transformation module using the pneumatic/hydraulic pressure for actuating the vacuum module, making the vacuum module create vacuum suction force of the at least one vacuum cup and mooring the mooring object;

wherein rest of the pneumatic/hydraulic pressure is stored in the energy transformation module.

10. The operating method of a mooring device as claimed in claim 9, wherein after the step (F), further comprising:

(G) the mooring object sending a detaching signal to the mooring device;

(H) the vacuum module removing the vacuum suction force of the at least one vacuum cup, and letting the mooring object leave;

(I) the third valve and the fourth valve opening and releasing the pneumatic/hydraulic pressure which is stored in the energy transformation module and the at least one first pressure tank to the at least one piston unit; and (J) the at least one piston unit resetting the at least one actuator to an original status before engaging with the mooring object.

* * * * *